US006390007B1

(12) United States Patent
Walker

(10) Patent No.: US 6,390,007 B1
(45) Date of Patent: May 21, 2002

(54) DRAIN PLUG SYSTEM FOR A BOAT

(75) Inventor: William T. Walker, Little Rock, AR (US)

(73) Assignee: Walk-Winn Plastic Co., Inc., Little Rock, AR (US)

( * ) Notice: Subject to any disclaimer, the term of this patent is extended or adjusted under 35 U.S.C. 154(b) by 0 days.

(21) Appl. No.: 09/837,845

(22) Filed: Apr. 18, 2001

(51) Int. Cl.[7] ..... B63B 13/00

(52) U.S. Cl. ..... 114/183 R; 220/375

(58) Field of Search ..... 114/183 R, 197; 220/375

(56) References Cited

U.S. PATENT DOCUMENTS

| | | | | | |
|---|---|---|---|---|---|
| 1,408,082 | A | * | 2/1922 | Dowler | 220/375 |
| 2,604,225 | A | * | 7/1952 | Armstrong | 220/375 |
| 3,859,945 | A | * | 1/1975 | Moeller | 114/197 |
| 4,867,337 | A | * | 9/1989 | Eichenseer | 220/375 |
| 4,930,657 | A | | 6/1990 | Walker | 220/235 |

* cited by examiner

*Primary Examiner*—Ed Swinehart
(74) *Attorney, Agent, or Firm*—Robert M. Gamson; Leonard Bloom

(57) ABSTRACT

A drain plug system for a boat which has a sleeve in the drain opening and an expandable drain plug to be disposed in the sleeve. A retainer is connected to the drain plug. The retainer is disposed within the sleeve and has ends which engage the inner side of the sleeve when the drain plug is contracted so that the drain plug is prevented from being lost.

4 Claims, 4 Drawing Sheets

DRAIN PLUG SYSTEM FOR A BOAT

BACKGROUND OF THE INVENTION

1. Field of the Invention

The present invention relates to a drain plug system for the drain opening of a boat and more particularly to a drain plug which is retained when the plug is disconnected from the sleeve in the drain opening.

2. Description of Related Art

Drain plugs for boats have been known for many years and are used for boats with wooden, metal, or plastic hulls. Generally, a sleeve is disposed in the drain opening. Presently, the sleeves are made of brass or aluminum and are swaged in a fiberglass boat and welded in an aluminum boat. The installation of the sleeve is labor intensive and tedious to ensure that a watertight fitting is made between the sleeve and the hull. To prevent loss of the plug, a chain is attached to the plug and to the inside transom of the boat. In order to insert the plug from the outside of the boat requires removal of the chain and possible loss of the plug. One of the major advantages of the plug of U.S. Pat. No. 4,930,657, owned by the present inventor, is that the plug floats and is not lost.

There is a need for a drain plug system which is more economical to install and which avoids loss of the drain plug when the drain plug is inserted and removed in the sleeve from the exterior of the hull.

BRIEF SUMMARY OF THE INVENTION

It is an object of the present invention to provide a drain plug system for a boat which is installed and maintained economically.

It is a further object of the present invention to provide a drain plug system for a boat wherein the drain plug is prevented from being lost.

In accordance with the teachings of the present invention, there is disclosed a drain plug system for a boat having a sleeve disposed in a drain opening in a hull of the boat. The sleeve has a first end disposed interiorly of the hull and a second end disposed exteriorly of the hull. A drain plug has a radially expandable hollow cylindrical body, the body having an upper end and a lower end. An expander assembly is received within the hollow cylindrical body. The expander assembly has a unitary annular flange formed thereon, the flange engaging the lower end of the body. A protrusion is formed on the flange on the expander assembly. The protrusion extends outwardly from the body. The protrusion has a through opening formed transversely therein. A V-shaped retainer has a pair of arms, each arm having a respective hook-shaped end. The V-shaped retainer is received in the through opening in the protrusion on the expander assembly wherein the hook-shaped ends of the retainer are distal from the expander assembly. When the V-shaped retainer is compressed and the drain plug disposed in the second end of the sleeve, the hook-shaped ends of the retainer extend into the interior of the hull. A manually manipulatable handle means is connected to the expander assembly wherein moving the expander assembly toward the handle means radially expands and axially compresses the body to seal the drain plug within the sleeve, and moving the expander assembly away from the handle means radially contracts and axially expands the body to permit removal of the drain plug from the sleeve. When the drain plug is removed from the sleeve, the hook-shaped ends of the retainer engage the first end of the sleeve such that the drain plug is retained outside the sleeve and is not lost.

In further accordance with the teachings of the present invention, there is disclosed a drain plug system for a drain opening in a hull of a boat. A sleeve is disposed in the drain opening, the sleeve having a first end disposed interiorly of the hull. An expandable drain plug has a first end receivable in the sleeve. Means are provided for expanding and contracting the drain plug wherein when expanded, the drain plug seals the sleeve. A retainer is connected to the first end of the drain plug, the retainer having ends distal from the drain plug. The ends are engagable with the first end of the sleeve when the drain plug is contracted, such that the drain plug is prevented from being lost.

These and other objects of the present invention will become apparent from a reading of the following specification taken in conjunction with the enclosed drawings.

DESCRIPTION OF THE PREFERRED EMBODIMENTS

Figure 1:
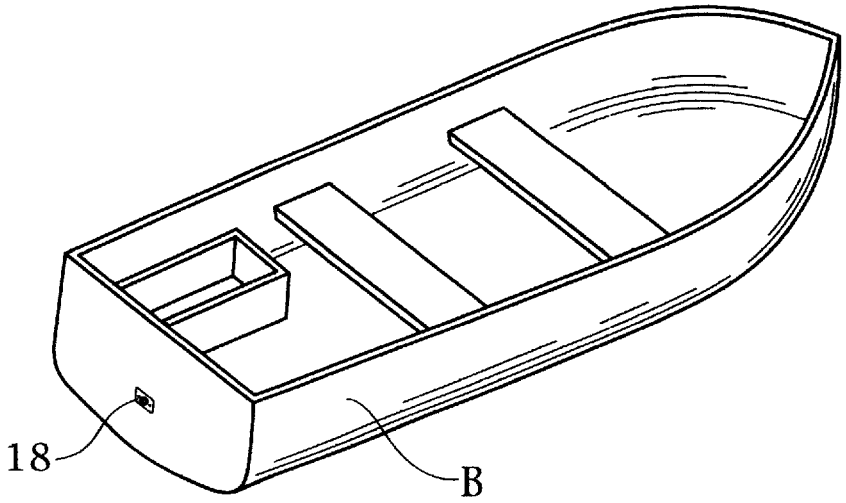
FIG. 1 is a perspective view of a boat in which the present invention is installed.
Figure 2:
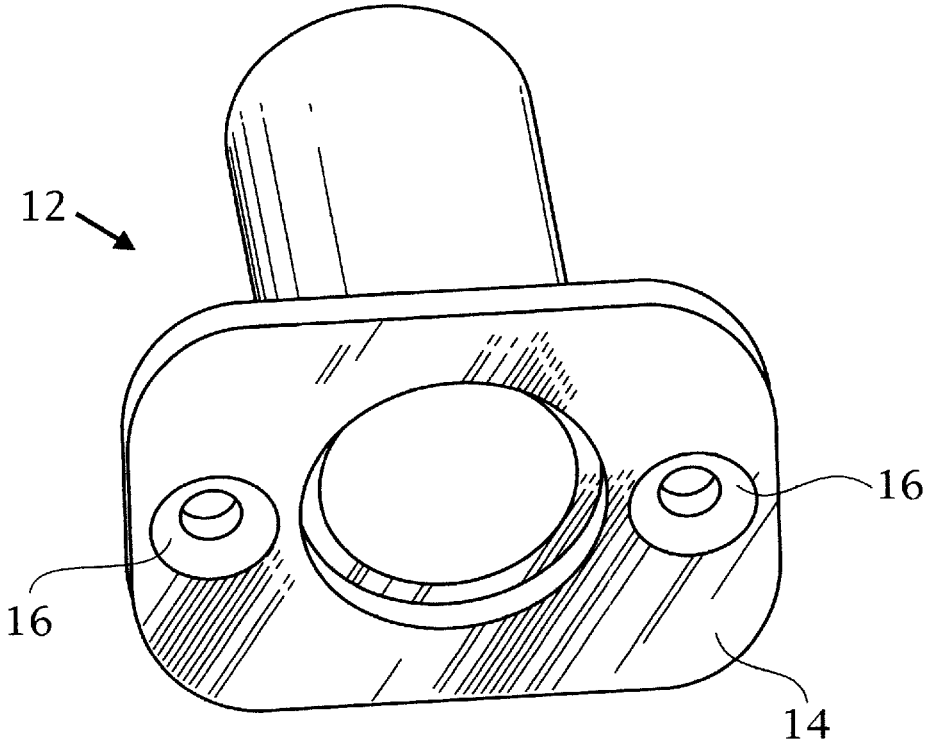
FIG. 2 is a perspective view of the sleeve.

Referring now to FIG. 1, the system 10 is preferably installed in the transom of the hull of a boat B where there is a drain opening. A sleeve 12 having a flange 14 (FIG. 2) is disposed in the drain opening so that the flange 14 is on the exterior of the hull and the sleeve 12 extends inwardly into the boat. Preferably, the sleeve 12 is formed from a rigid plastic. The flange 14 may have at least two openings 16 formed therein so that, if desired, fasteners may be inserted in the openings 16 and received in the hull of the boat B to secure the sleeve. If the boat is aluminum, screws or rivets may be used as fasteners. Alternately, the flange may be adhered to the hull of the boat B. In any method of attaching the sleeve 12 and flange 14 to the boat, a polymeric material 13 such as silicone is disposed between the hull and the sleeve/flange to assure a watertight seal.

Figure 3:
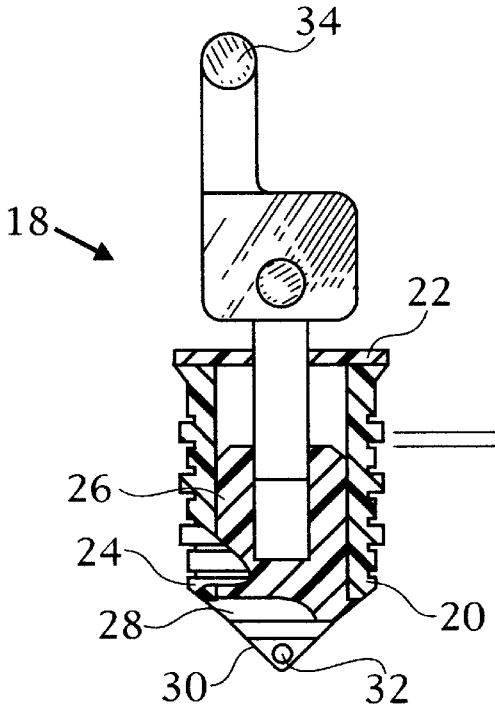
FIG. 3 is a partial cut-away side elevation view of the drain plug with the body radially contracted.
Figure 4:
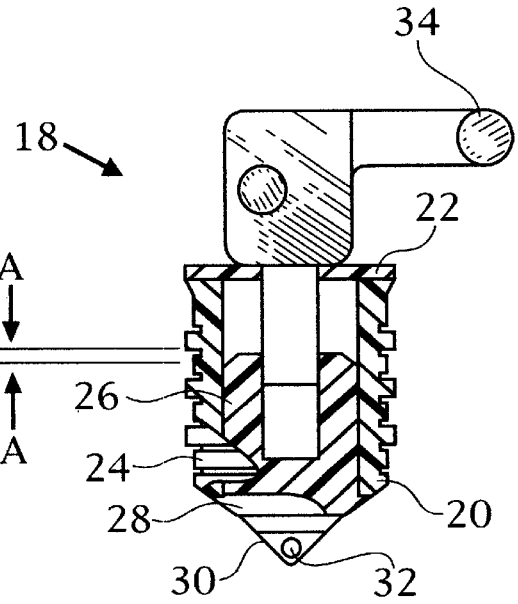
FIG. 4 is a partial cut-away side elevation view of the drain plug with the body radially expanded.

As shown in FIGS. 3 and 4, a drain plug 18 has a radially expandable hollow cylindrical body 20. The body 20 has an upper end 22 and a lower end 24. An expander assembly 26 is received within the hollow body 20. The expander assembly 26 has a unitary annular disc 28 formed on the lower end of the expander assembly 26 and disposed outwardly from and engaging the lower end of the body 20. A protrusion 30 is formed on the disc 28 extending outwardly from the body

20. A through opening 32 is formed transversely in the protrusion 30. A manually manipulatable handle means 34 is connected to the top of the expander assembly 26. Moving the handle means 34 away from the expander assembly 26 (FIG. 3) radially contracts and axially expands the body 20. Moving the handle means 34 toward the expander assembly 26 (FIG. 4) radially expands and axially compresses the body. The extent of movement between the two positions of the expander assembly is shown as A—A.

Figure 5:
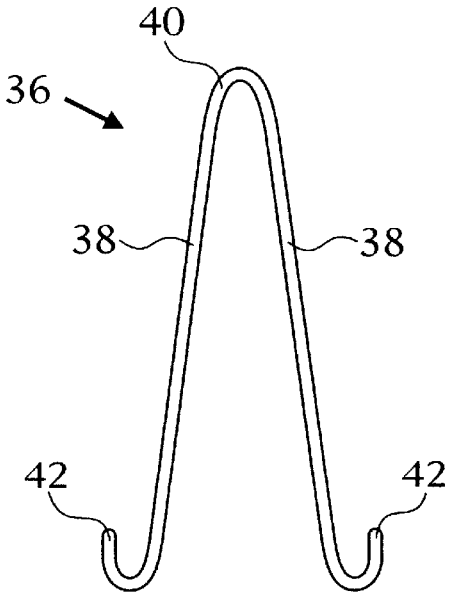
FIG. 5 is a top plan view of the retainer.
Figure 6:
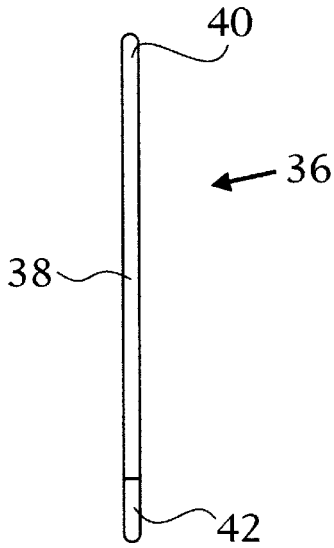
FIG. 6 is a side elevation view of the retainer.
Figure 7:
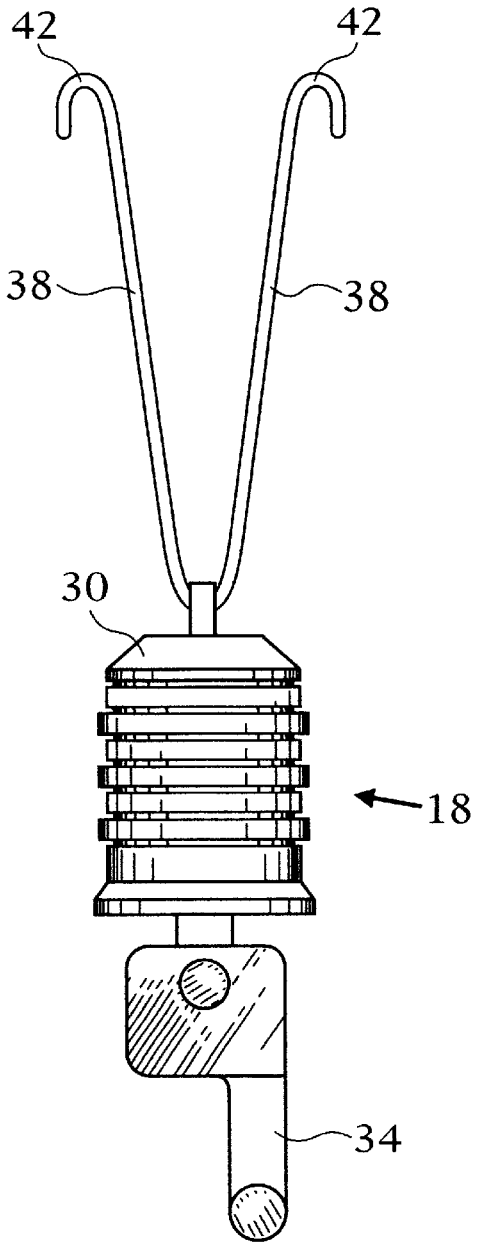
FIG. 7 is a side elevation view of the retainer connected to the drain plug.
Figure 8:
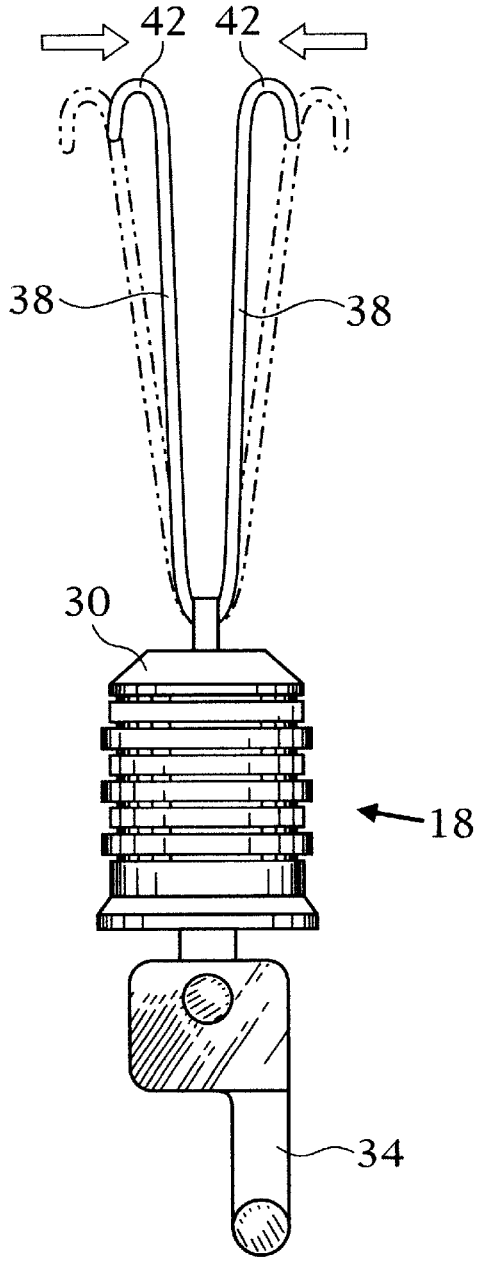
FIG. 8 is the view of FIG. 7 showing the arms of the retainer compressed.
Figure 9:
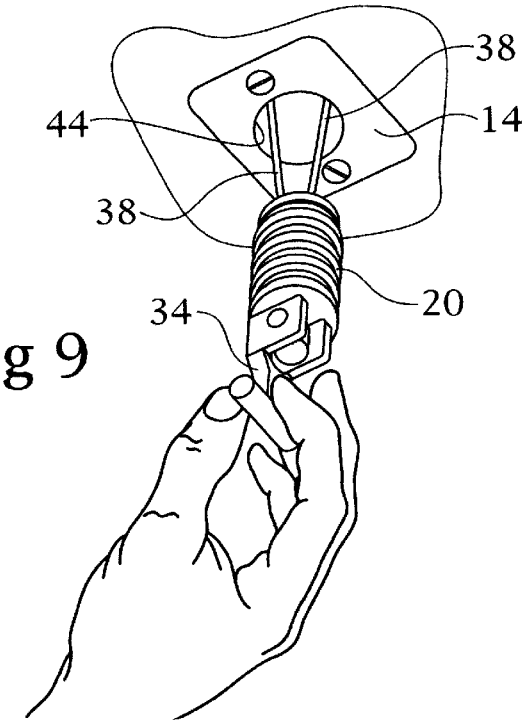
FIG. 9 is a perspective view of the compressed retainer and drain plug being introduced into the sleeve.

Referring now to FIGS. 5 and 6, a V-shaped retainer 36 has a pair of arms 38 with a bight portion 40 therebetween. Each arm 38 has a hook-shaped end 42 and each arm 38 has a length greater than the length of the sleeve 12. The V-shaped retainer 36 is received in the through opening 32 in the protrusion 30 on the disc 28 on the expander assembly 26. The bight portion 40 is disposed at the through opening 32 and the hook-shaped ends 42 are distal from the expander assembly 26 as shown in FIGS. 7 and 8. The arms 38 may be compressed as shown in FIG. 8 so that the retainer 36 may be inserted into the sleeve 12 as shown in FIG. 9. In their normal state, the hook-shaped ends 42 of the retainer 36 are spaced apart by a distance which is greater than the outer diameter of the sleeve 12. When the arms 38 of the V-shaped retainer are compressed to be inserted into the sleeve 12, the handle means 34 is disposed away from the expander assembly 26 to radially contract the body 20 and the body 20 may be inserted into the sleeve 12. Preferably, the inner circumference of the sleeve 12 has an annular shoulder 44 formed near the flange 14 such that the disc 28 on the expander assembly 26 abuts the annular shoulder 44 when the body 20 is inserted into the sleeve 12. This limits the insertion of the body 20 into the sleeve 12.

Figure 10:
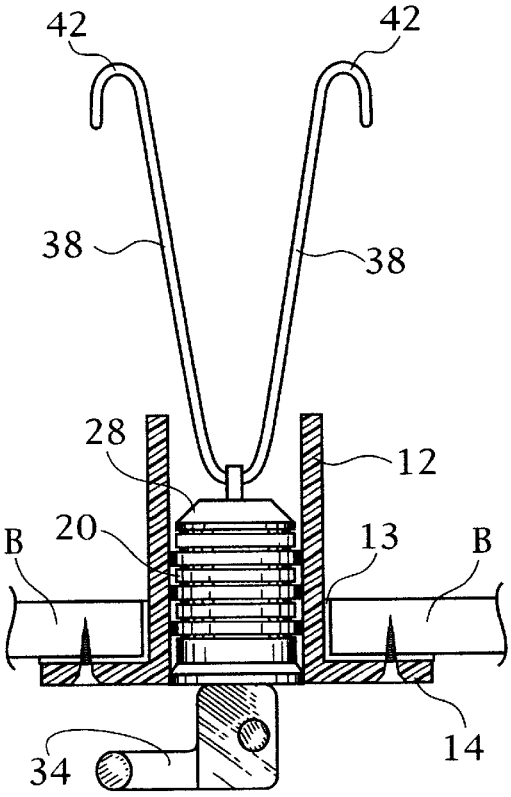
FIG. 10 is a partial cut-away view showing the drain plug with the radially expanded body sealing the sleeve and the retainer being within the hull.
Figure 11:
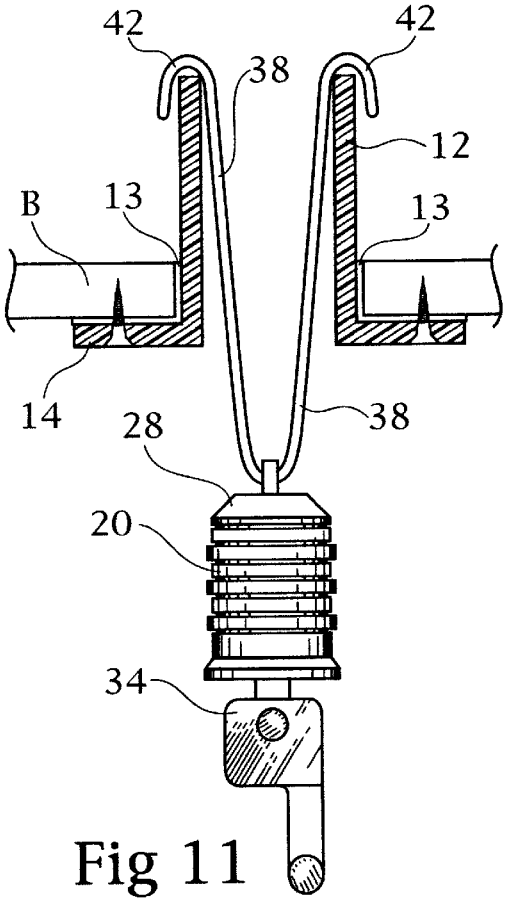
FIG. 11 is a partial cut-away view showing the retainer suspended from the sleeve and retaining the drain plug externally of the hull.

As shown in FIG. 10, after the disc 28 abuts the annular shoulder 44, the handle means 34 is rotated toward the expander assembly 26 to radially expand the body 20 and seal the drain plug 18 within the sleeve 12. The V-shaped retainer 36 extends into the hull with the hook-shaped ends 42 beyond the inner end of the sleeve 12. In order to remove the drain plug 18, as shown in FIG. 11, the handle means 34 is rotated away from the expander assembly 26 to radially compress the body 20. The body 20 has a diameter less than the internal diameter of the sleeve 12 and falls from or is removed from the sleeve 12. However, due to the distance between the hook ends 42 of the arms 38 of the retainer 36 being greater than the outer diameter of the sleeve 12 and due to the length of the arms 38, the drain plug 18 is suspended exteriorly of the flange 14 on the sleeve 12. The hook-shaped ends 42 engage the inner end of the sleeve 12 so that the drain plug 18 can be completely removed only by compressing the arms 38 to reduce the distance between the hook-shaped ends to be less than the inner diameter of the sleeve 12.

In this manner, the drain plug 18 cannot be lost but is immediately adjacent to the sleeve 12 in the drain opening at all times so that the drain plug 18 is immediately accessible when the drain opening is to be closed.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with a drain plug for an opening in a boat, wherein the drain plug may be expanded to provide a seal in the opening in the boat and wherein the drain plug may be contracted and removed from the opening in the boat, the improvement comprising:

a cylindrical sleeve disposed in the opening in the boat, the drain plug being received in the cylindrical sleeve, the sleeve having an inner end portion within the boat, an inner end of the drain plug having a protrusion formed thereon, a through opening being formed transversely in the protrusion, a V-shaped retainer having a bight portion, the bight portion of the retainer being received in the through opening in the protrusion such that the drain plug is secured to the retainer, the retainer further having a pair of bifurcated diametrically-opposed arms, each arm terminating in a projecting hook oriented toward the bight portion, such that when the drain plug is contracted and removed from the sleeve in the boat, the respective hooks on the ends of the arms engage over the inner end portion of the sleeve, thereby preventing loss of the drain plug even though the drain plug may be completely removed from the sleeve in the opening.

2. The combination of claim 1, wherein an outwardly-extending flange is formed on an outer end portion of the sleeve, the flange being exteriorly of the boat and being connected to the boat.

3. The combination of claim 2, wherein the flange has at least two openings formed therein, a respective fastener being disposed in each opening wherein the sleeve is attached to the boat.

4. The combination of claim 1, wherein each arm of the retainer has a length approximately equal to the length of the other arm, the sleeve having a length less than the length of the arms, such that when the drain plug is contracted and the arms of the retainer engage the inner end portion of the sleeve, the drain plug is retained outside of the sleeve providing an unobstructed opening in the boat.

* * * * *